US005621953A

United States Patent [19]

Fildan

[11] Patent Number: 5,621,953

[45] Date of Patent: Apr. 22, 1997

[54] OVERALL BUCKLE

[76] Inventor: Gerhard Fildan, Wohnpark Alte Erlaa, Anton Baumgartner Str. 44, C 4 17 01, A-1232, Vienna, Austria

[21] Appl. No.: 371,546

[22] Filed: Jan. 11, 1995

[51] Int. Cl.[6] ..... A44B 11/12

[52] U.S. Cl. ..... 24/170; 24/191; 24/193; 24/322.1

[58] Field of Search ..... 24/170, 191, 197, 24/585, 637, 641, 192, 193, 322.1, 323, 324

[56] References Cited

U.S. PATENT DOCUMENTS

| | | | |
|---|---|---|---|
| 2,822,595 | 2/1958 | Ruhl | 24/170 |
| 3,703,024 | 11/1972 | Johnson | 24/71 R X |
| 4,373,234 | 2/1983 | Boden | 24/191 |
| 4,567,628 | 2/1986 | Prete, Jr. et al. | 24/191 X |

FOREIGN PATENT DOCUMENTS

| | | | |
|---|---|---|---|
| 0079479 | 5/1983 | European Pat. Off. | 24/193 |
| 2613487 | 10/1977 | Germany | 24/170 |
| 2722 | 9/1868 | United Kingdom | 24/191 |
| 729574 | 5/1955 | United Kingdom | 24/322.1 |
| 2122296 | 1/1984 | United Kingdom | 24/193 |

*Primary Examiner*—Peter M. Cuomo
*Assistant Examiner*—Hanh V. Tran
*Attorney, Agent, or Firm*—Herbert Dubno

[57] ABSTRACT

An overall buckle in which the swingable flap has a detent locking the flap in its closed position so that inadvertent opening is prevented. The teeth of the flap cooperate with counterteeth on the frame so that transversely, the strap has an undulating pattern when clamped. The strap passes through the buckle in an undulating pattern as well.

11 Claims, 4 Drawing Sheets

FIG. 6
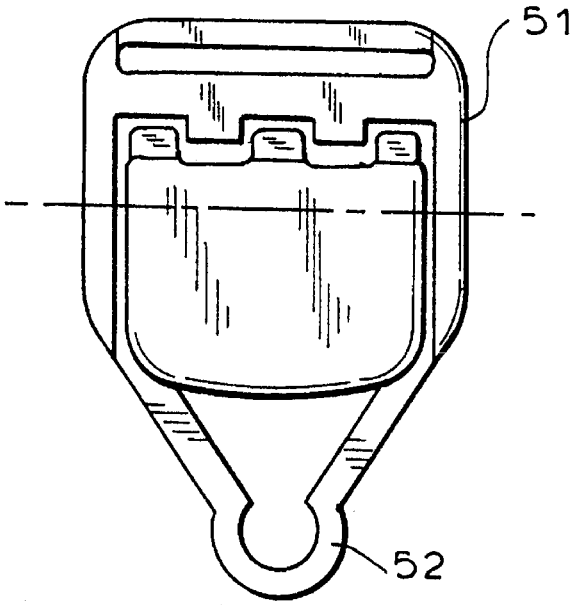
FIG. 8
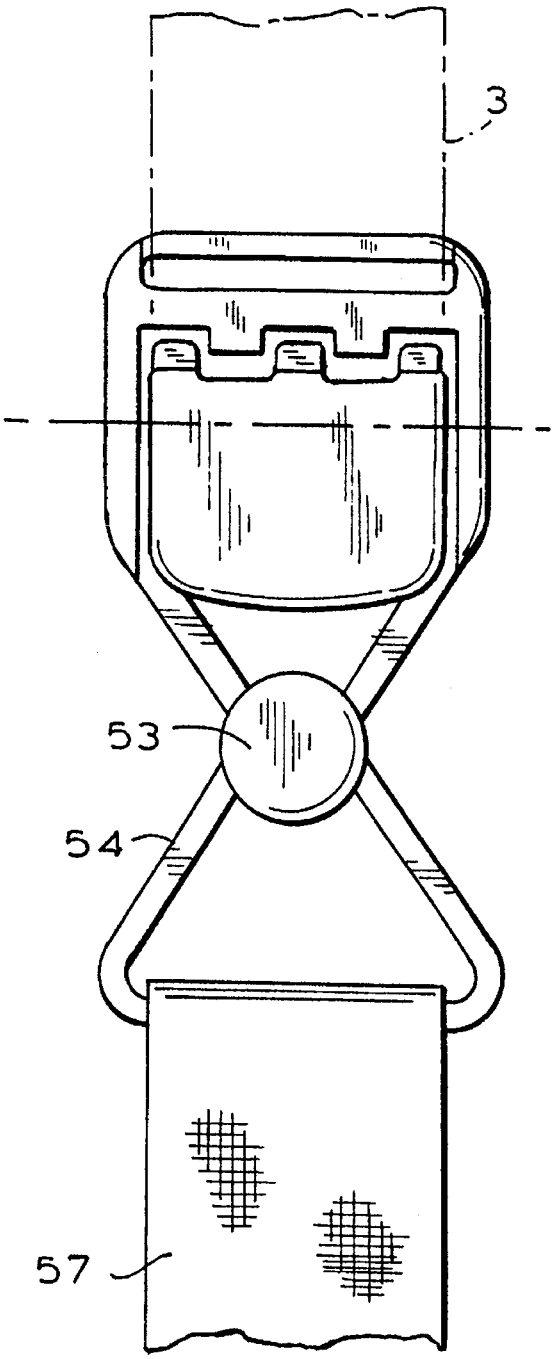
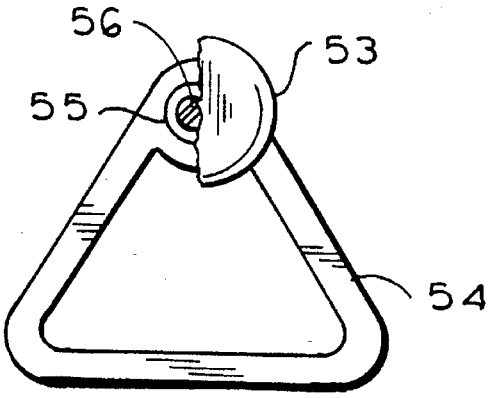
FIG. 7

OVERALL BUCKLE

FIELD OF THE INVENTION

My present invention relates to an overall buckle and, more particularly, to a buckle which enables the adjustment of a shoulder strap relative to the bib portion of overalls by opening and closing the buckle via a swingable flap. More particularly, the invention relates to an overall bib of the type having a frame and a flap swingable on the frame between opening and closing positions whereby, in the open position, adjustment of a strap is possible and, in the closed position, the strap is so engaged between the flap and the frame that sliding of the strap through the frame is precluded.

BACKGROUND OF THE INVENTION

Overall buckles having flaps swingable in a frame are known but, because of the construction of the regions of interengagement of the flap with the strap, thin straps are poorly gripped, thicker straps often cannot be clamped effectively and inadvertent opening of the buckle frequently cannot be avoided.

OBJECTS OF THE INVENTION

It is, therefore, the principal object of the present invention to provide an improved overall buckle which is free from these drawbacks and, especially, enables straps of a variety of thicknesses to be reliably and uniformly gripped.

Another object of this invention is to provide an overall buckle which can securely lock the strap in place in its adjusted position without the danger of inadvertent opening.

SUMMARY OF THE INVENTION

Basically, these objects can be attained by an overall buckle which is formed with detent means enabling the flap to be locked in its closed position relative to the frame against inadvertent opening and requiring, therefore, a detent unlocking force to be intentionally supplied by the user to open the buckle.

More particularly, an overall buckle according to the invention can comprise:

- a frame formed with means at one end of the frame for detachably securing the buckle to a bib portion of an overall, and a pair of lateral limbs;
- a flap swingably mounted on the frame between the limbs, the flap having teeth cooperating with counterteeth on the frame for gripping a strap of the overall in a closed position of the flap and for releasing the strap in an open position of the flap, thereby enabling adjustment of the strap relative to the bib portion; and
- detent means between the frame and the flap releasably locking the flap in the closed position against unintentional opening.

For effective retention of a strap with higher resistance to tension and better engagement especially of the straps, according to a feature of the invention, the flap is formed as a double arm lever and the teeth of the flap are provided as fingers projecting from or constituting the shorter arm of the lever. In the closed position, these fingers engage between, i.e. interdigitate, with the counterteeth which project from a bar of the frame, either a separate bar or a limb of the frame itself, parallel to the pivot axis of the cover and between the pivot axis and the terminal limb of the frame which is parallel to the pivot axis.

According to another feature of the invention, the detent means is a snap-type catch formed by a projection, nose or the like from the pivot portion of the flap and which extends downwardly in the closed position of the buckle. Upon displacement into this closed position, the projection snaps behind a resilient bar of the frame parallel to the pivot axis.

Advantageously, the detent is provided longitudinally midway of the frame, a positioning which allows uniform and easy engagement of the detent both with thick and with thin straps.

According to a further feature of the invention, the bar of the detent is provided between at least one slit whose longitudinal plane is perpendicular to the frame plane. This provides the bar with the requisite yieldability and elasticity while it retains sufficient stiffness to provide a firm lock of the projection in the closed position. In one embodiment, a single slit is provided over the entire central position of the bar although, for greater stiffness, a pair of slits can flank the central plane which is free from any slit and thus is somewhat stiffer.

According to another feature of the invention, the means for pivotally mounting the flap on the frame is provided with sufficient play to enable the flap to engage thicker straps.

The interdigitating fingers and counterfinger or teeth and counterteeth can be designed so that the strap passes alternately upwardly and downwardly in the closed position of the flap in an undulating or sinusoidal pattern. The counterteeth can project from the bar upon which they are mounted and can have inclined surfaces over which the strap passes.

The teeth and counterteeth can lie substantially in a common plane in the closed position or have surfaces which are substantially coplanar according to the invention.

With the frame vertical in its normal use position, the flap can be swung into a horizontal position, i.e. the open position in which the upper surfaces of the teeth or fingers can lie in a common plane. The ends of the teeth can be inclined toward these surfaces at an acute angle In an embodiment of the invention in which the means for attaching the buckle to the bib portion of the overall is another strap, the lower end of the frame can be closed by a downwardly convex limb. Alternatively, the frame may be provided at this end with an eye engageable over a button on the bib portion.

BRIEF DESCRIPTION OF THE DRAWING

The above and other objects, features, and advantages will become more readily apparent from the following description, reference being made to the accompanying drawing in which:

FIG. 6 is a view similar to FIG. 1 of another embodiment of the buckle having an eye for engagement with a button;

Figure 5:
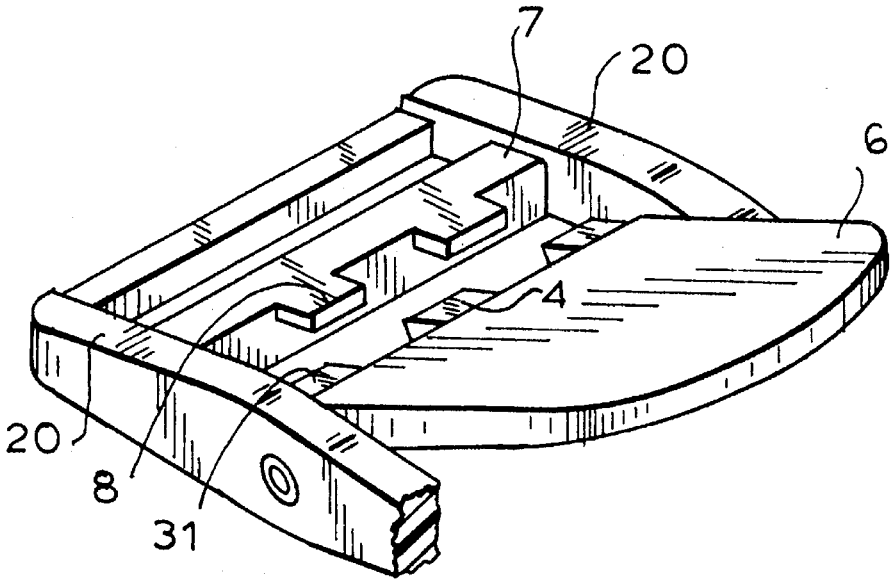
FIG. 5 a perspective view of the toothed portion of the buckle with the flap partly open.
Figure 9:
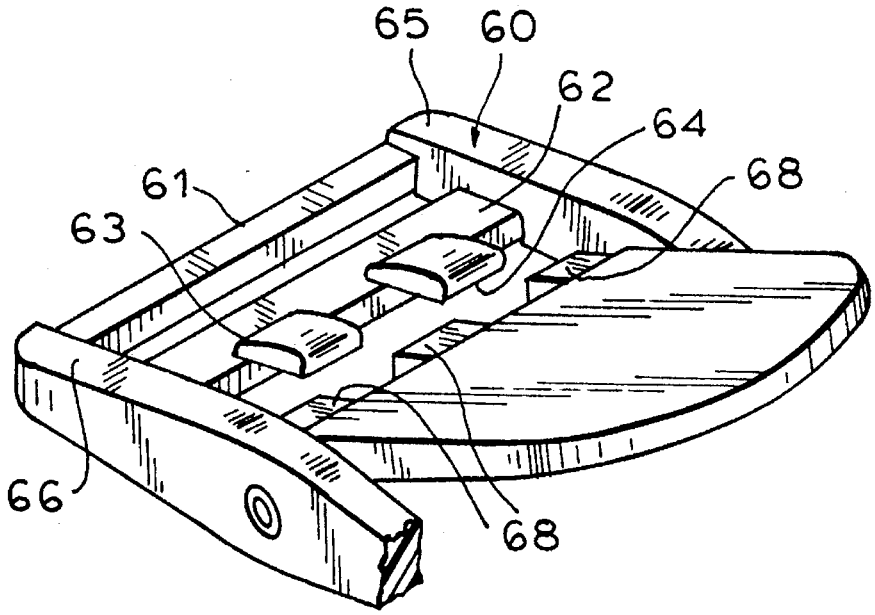
Figure 10:
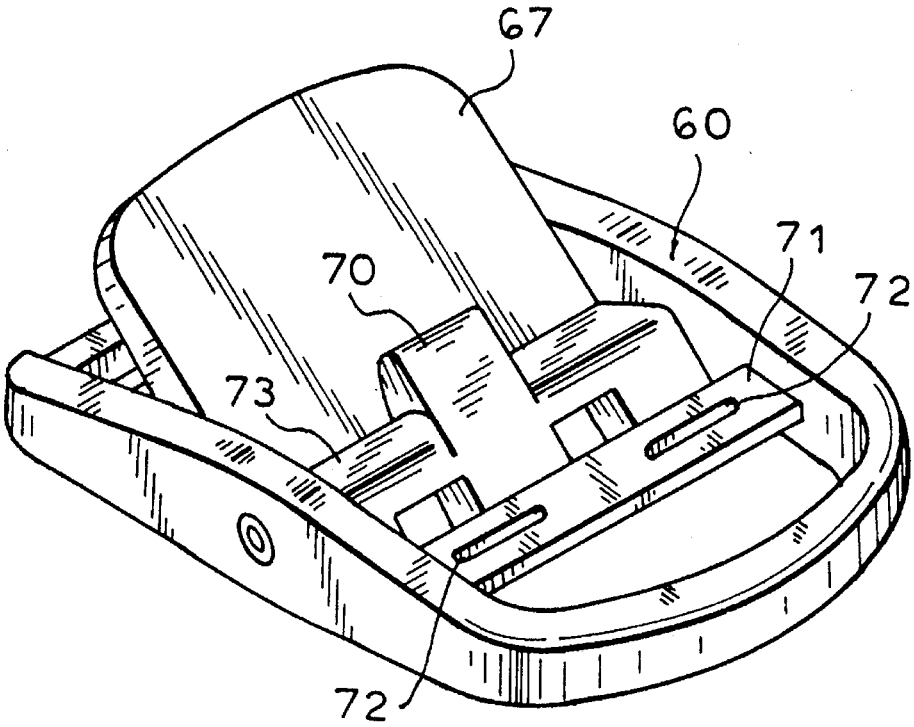

FIG, 7 is an elevational view, partly broken away of a button on a strap loop for connecting the buckle to a bib portion of the overall;

FIG. 8 is an elevational view showing the buckle of FIG. 6 engaged with the button of FIG. 7;

FIG. 9 is a fragmentary perspective view similar to FIG. 5 but showing another embodiment of the invention; and FIG. 10 is a perspective view of this other embodiment with a modified detent bar.

SPECIFIC DESCRIPTION

The buckle shown in FIGS. 1–5 comprises a generally rectangular frame 1 with an upper straight limb 11, a downwardly and outwardly convex lower curved limb 19 and a pair of lateral limbs 20 between which a double arm lever 2 in the form of a pivoting flap is swingable.

The flap 2 has a pair of laterally projecting pins 21 which are received with a play 16 in bores 22 of the lateral limbs 20 of the frame.

Figure 1:
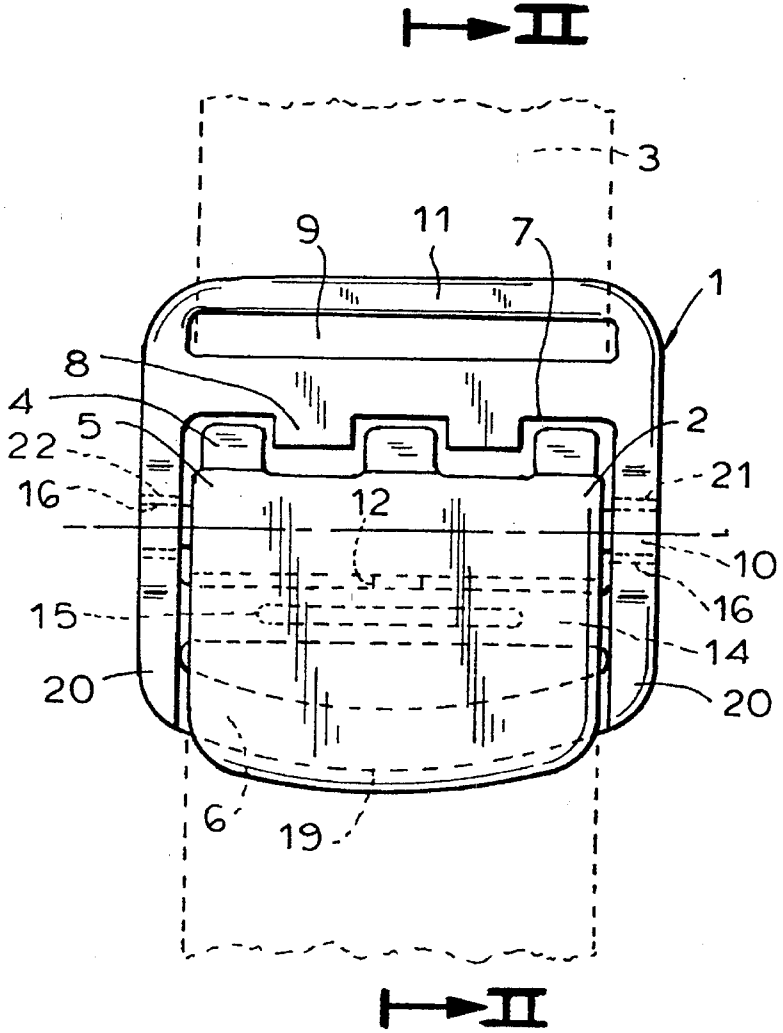
FIG. 1 Is a front view of an overall buckle with the flap in its closed position.

The flap 2 is so configured and mounted that, in the closed position of the buckle, a shorter lever arm 5 reaches toward the limb 11 and a longer lever arm 6 reaches toward and over the lower limb 19 and, as can be seen from FIG. 1, covers the latter. This construction allows a high mechanical advantage to be obtained which ensures clamping of even thick straps.

From the upper free edge of the short lever arm 5, three spaced apart fingers or teeth 4 project upwardly in the closed position. Two of these teeth or fingers 4 are located immediately adjacent the limbs 20 while the third is disposed along the longitudinal median axis of the flap and hence the buckle.

The teeth 4 engage in spaces 7 between teeth or fingers 8 of an opposing cross bar 9 of the frame 1. More particularly, the central tooth 4 lies between the two counterteeth 8 and the outer teeth 4 flank the teeth 8.

The bar 9 is disposed between the pivot axis 10 of the flap 2 and the upper limb 11 of frame 1. The ends of the teeth 4 have surfaces 18 which are inclined at acute angles to the surfaces 17 which lie in a common plane. The inclined ends 18 also lie in a common plane. As FIG. 2 shows, the teeth 4 and the teeth 8 interdigitate in the closed position of the flap 2 so that the surfaces 17 lie in the gaps 7 between the counterteeth 8 and the teeth are generally coplanar.

Figure 2:
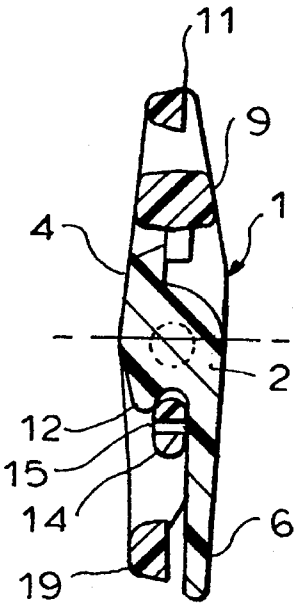
FIG. 2 is a cross sectional view thereof taken long the line II—II in FIG. 1.
Figure 3:
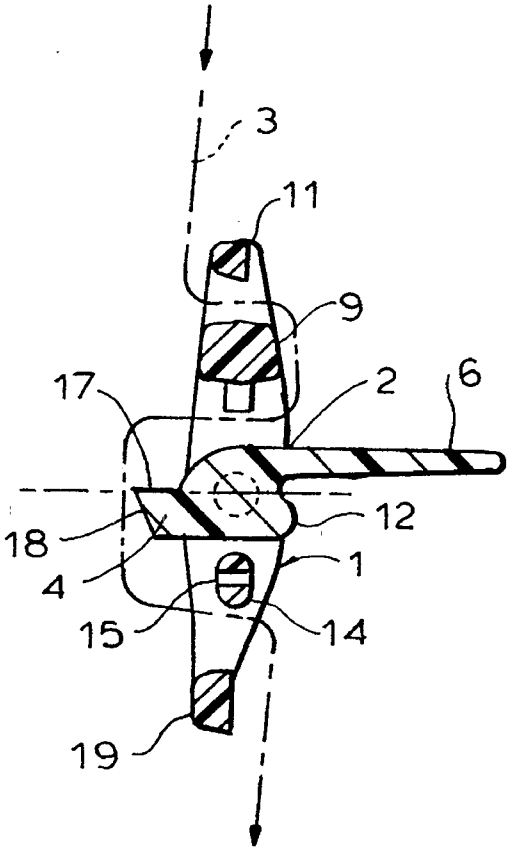
FIG. 3 is a cross sectional view similar to FIG. 2 with the flap in its open position.
Figure 4:
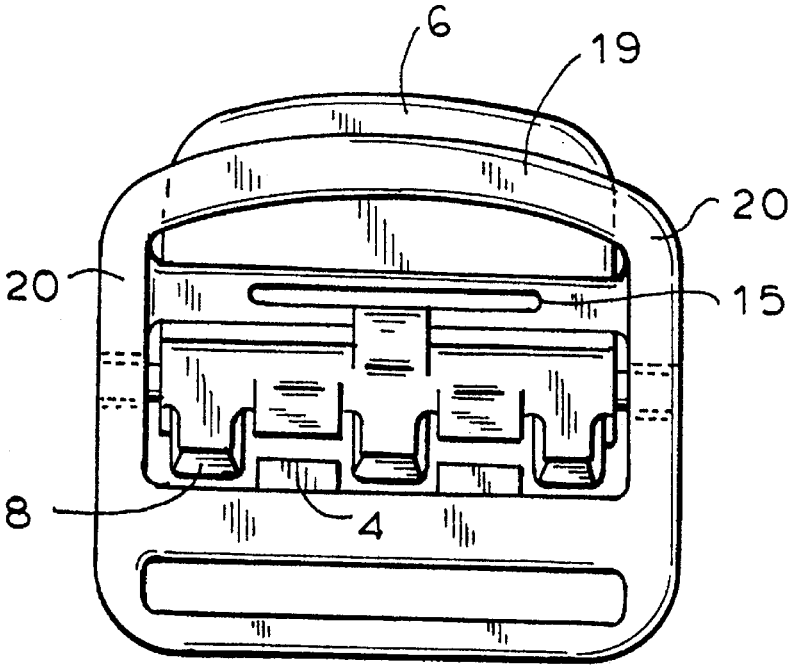
FIG. 4 is a rear view of the buckle in its closed position.

As can be seen from FIG. 2, the flap 2 also has a detent device which is formed by a central projection, tooth nose or the like 12 and a resilient bar 14 opposite this projection.

In the embodiment of FIGS. 1–5, the bar 14 has a longitudinal slit 15 which is perpendicular to the frame plane so that the central portion of this bar is resilient and the projection 12 can engage behind it as the flap is swung from its open position into its closed position, thereby snap locking the flap in the closed position. At 3 in FIG. 3, the strap is shown as it passes through the buckle with an undulating pattern in the longitudinal direction.

Since the teeth 4 and counterteeth 8 interdigitate, when the strap is clamped it will be apparent that the strap will pass over the teeth 8 and over the teeth 4 in an undulating pattern 31. When the teeth lie in substantially the same plane in a closed position of the flap, the straps can be of various thicknesses and will be reliably locked when the detent engages.

In FIG. 6 I have shown a buckle 51 otherwise similar to that of FIG. 1 but formed with an eye 52 which can engage over a button 53 best seen in FIG. 7. The button 53 can be anchored directly to the bib portion or connected to the bib portion by a loop 54. The loop 54 can be formed with a bore 55 in which a shank 56 of the button 53 can be snap fitted. The bib can have a strap 57 stitched over the loop 54 (FIG. 8).

FIG. 9 shows a modification of the buckle of FIGS. 1–5 wherein the frame 60 has a straight limb 61, a bar 62 bearing the counterteeth 63 and 64, and the lateral limbs 65 and 66. The flap 67 is journaled in the lateral limbs 65, 66 and has teeth 68 which interdigitate with the teeth 63. In this embodiment, the teeth 63 and 64 project above the bar 62 and have ramp-like configurations rising toward the flap 67.

As can be seen from FIG. 10, the projection or tooth 70 on the flap 67 can engage beneath a resilient bar 71 which has two slits 72 for increasing the flexibility of this bar. However, the slits 72 are located at opposite sides of a region 73 which is free from the slit so that the bar 71 in this embodiment is stiffer than the bar 14 previously described.

I claim:

1. An overall buckle comprising:

a frame formed with means at a first end of said frame for detachably securing said buckle to a bib portion of an overall, and a pair of lateral limbs;

a flap swingably mounted on said frame between said limbs, said flap having an intermediate portion provided with a pivot axis and teeth on one side of said axis cooperating with counterteeth on said frame for gripping a strap of the overall in a closed position of said flap and for releasing said strap in an open position of said flap, thereby enabling adjustment of the strap relative to said bib portion, said flap having an arm extending to an opposite side of said axis said counterteeth projecting from said frame and terminating in a plane, said teeth extending toward said counterteeth and beyond said plane to interdigitate with said counterteeth in said closed position between said lateral limbs, each of said teeth and counterteeth having a respective generally rectangular outline; and detent means between said frame and said flap releasably locking said flap in said closed position against unintentional opening, said detent means including a projection formed on said flap on said opposite side and a flexible bar spanning said limbs in a path of said projection, positioned for deflection by said projection whereby said projection engages behind said bar in said closed position, said bar being formed with at least one slit extending through said bar in a longitudinal plane perpendicular to a plane of the frame for facilitating flexing of said bar.

2. The overall buckle defined in claim 1 wherein said flap is a double-arm lever swingable about an axis transverse to said limbs and having a long arm lying generally parallel to said frame in said closed position, said teeth projecting from a short arm of said lever and interdigitating with said counterteeth.

3. The overall buckle defined in claim 2 wherein said bar is parallel to and spaced inwardly from a limb of said frame at an end opposite the first-mentioned end.

4. The overall buckle defined in claim 3 wherein said teeth and counterteeth are so oriented in said closed position that said strap passes alternately over alternating teeth and counterteeth in an undulating pattern between said limbs.

5. The overall buckle defined in claim 1 wherein said detent means is located substantially midway of a length of the frame.

6. The overall buckle defined in claim 1, further comprising means pivotally mounting said flap on said frame with a play sufficient to enable engagement of thick straps between said teeth and counterteeth.

7. The overall buckle defined in claim 1 wherein said teeth and counterteeth have surfaces lying substantially in a common plane in said closed position of said flap.

8. The overall buckle defined in claim 7 wherein said teeth have ends inclined at acute angles to said surfaces of said teeth which lie in said plane in said closed position.

9. The overall buckle defined in claim 1 wherein said means at one end of said frame for detachably securing said buckle to said bib portion includes an outwardly bowed limb of said frame at said end.

10. The overall buckle defined in claim 1 wherein said means at one end of said frame for detachably securing said buckle to said bib portion includes an eye engageable over a button connected to said bib portion.

11. An overall buckle comprising:

a frame formed with means at one end of said frame for detachably securing said buckle to a bib portion of an overall, and a pair of lateral limbs;

a flap swingably mounted on said frame between said limbs, said flap having teeth cooperating with counter-teeth on said frame for gripping a strap of the overall in a closed position of said flap and for releasing said strap in an open position of said flap, thereby enabling adjustment of the strap relative to said bib portion; and detent means between said frame and said flap releasably locking said flap in said closed position against unintentional opening, said detent means including:

a tooth formed on said flap, a flexible bar spanning said limbs in a path of said tooth, positioned for deflection by said tooth whereby said tooth engages behind said bar and midway between said limbs in said closed position, said bar being formed with at least one longitudinally extending slit therethrough in a plane perpendicular to a plane of the frame for facilitating flexing of said bar.

* * * * *